US006245290B1

(12) United States Patent
Koo et al.

(10) Patent No.: US 6,245,290 B1
(45) Date of Patent: Jun. 12, 2001

(54) HIGH-TENSILE-STRENGTH STEEL AND METHOD OF MANUFACTURING THE SAME

(75) Inventors: Jayoung Koo, Bridgewater; Narasimha-Rao V. Bangaru, Annandale; Michael J. Luton, Bridgewater, all of NJ (US); Clifford W. Petersen, Missouri City, TX (US); Kazuki Fujiwara, Nishinomiya (JP); Shuji Okaguchi, Yao (JP); Masahiko Hamada, Amagasaki (JP); Yu-ichi Komizo, Nishinomiya (JP)

(73) Assignees: ExxonMobil Upstream Research Company, Houston, TX (US); Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/380,254

(22) PCT Filed: Feb. 26, 1998

(86) PCT No.: PCT/US98/02966

§ 371 Date: Aug. 25, 1999

§ 102(e) Date: Aug. 25, 1999

(87) PCT Pub. No.: WO98/38345

PCT Pub. Date: Sep. 3, 1998

(30) Foreign Application Priority Data

Feb. 27, 1997 (JP) ..... 9-043630

(51) Int. Cl.[7] ..... C21D 8/00; C22C 38/08; C22C 38/48; C22C 38/50

(52) U.S. Cl. ..... 420/119; 420/108; 420/109; 420/112; 148/654; 148/336; 148/335

(58) Field of Search ..... 148/336, 335, 148/654; 420/108, 109, 112, 119

(56) References Cited

U.S. PATENT DOCUMENTS

| | | | |
|---|---|---|---|
| 4,572,748 | 2/1986 | Suga et al. | 148/12 |
| 5,213,634 | 5/1993 | DeArdo et al. | 148/334 |
| 5,531,842 | 7/1996 | Koo et al. | 148/654 |
| 5,545,269 | 8/1996 | Koo et al. | 148/654 |
| 5,545,270 | 8/1996 | Koo et al. | 148/654 |
| 5,653,826 | 8/1997 | Koo et al. | 148/328 |
| 5,755,895 | 5/1998 | Tamehiro et al. | 148/336 |
| 5,798,004 | 8/1998 | Tamehiro et al. | 148/336 |
| 5,900,075 | 5/1999 | Koo et al. | 148/328 |

FOREIGN PATENT DOCUMENTS

| | | |
|---|---|---|
| 57-134514 | 8/1982 | (JP) . |
| 58-52423 | 3/1983 | (JP) . |
| 7-331328 | 12/1995 | (JP) . |
| H8-176659A | 7/1996 | (JP) . |
| H8-295982A | 11/1996 | (JP) . |

*Primary Examiner*—Deborah Yee
(74) *Attorney, Agent, or Firm*—Marcy M. Hoefling

(57) ABSTRACT

A high-tensile-strength steel having excellent toughness throughout its thickness, excellent properties at welded joints, and a tensile strength (TS) of at least about 900 MPa (130 ksi), and a method for making such steel, are provided. Steels according to this invention preferably have the following composition based on % by weight: carbon (C): 0.02% to 0.1%; silicon (Si): not greater than 0.6%; manganese (Mn): 0.2% to 2.5%; nickel (Ni): 0.2% to 1.2%; niobium (Nb): 0.01% to 0.1%; titanium (Ti): 0.005% to 0.03%; aluminum (Al): not greater than 0.1%; nitrogen (N): 0.001% to 0.006%; copper (Cu): 0% to 0.6%; chromium (Cr): 0% to 0.8%; molybdenum (Mo): 0% to 0.6%; vanadium (V): 0% to 0.1%; boron (B): 0% to 0.0025%; and calcium (Ca): 0% to 0.006%. The value of Vs as defined by $Vs=C+(Mn/5)+5P-(Ni/10)-(Mo/15)+(Cu/10)$ is 0.15 to 0.42. P and S among impurities are contained in an amount of not greater than 0.015% and not greater than 0.003%, respectively. The carbide size in the steel is not greater than 5 microns in the longitudinal direction.

13 Claims, No Drawings

HIGH-TENSILE-STRENGTH STEEL AND METHOD OF MANUFACTURING THE SAME

FIELD OF THE INVENTION

The present invention relates to high-tensile-strength steel having excellent toughness throughout its thickness, excellent properties at welded joints, and a tensile strength (TS) of at least about 900 MPa (130 ksi). More particularly, the present invention relates to high-tensile-strength steel plate for construction of linepipe for transport of natural gas, crude oil, and the like, as well as to a method of manufacturing the high-tensile-strength steel plate.

BACKGROUND OF THE INVENTION

In pipelines for transport of natural gas and crude oil over a long distance, a reduction in transportation cost has been a universal need, and efforts have focused on improvement of transport efficiency by increasing the maximum working pressure. The standard approach to increasing maximum working pressure involves increasing the wall thickness of low-strength grade steel linepipe. Due to an increase in structural weight however, this method leads to a reduction in the efficiency of on-site welding as well as a reduction in overall pipeline construction efficiency. An alternative approach is to limit the increase in wall thickness by enhancement of the strength of the linepipe material. For example, the American Petroleum Institute (API) recently standardized X80 grade steel, and X80 grade steel has been put in practical use. "X80" means a yield strength (YS) of at least 551 MPa (80 ksi).

In view of anticipated increases in demand for even higher strength steel, several methods for the manufacture of X100 or higher grade steel have been proposed based on the technique used to manufacture X80 grade steel. For example, such a steel and a method of manufacturing the same have been proposed where the strength and toughness are enhanced through Cu precipitation hardening and refinement of the microstructure (Japanese Patent Application Laid-Open (kokai) No. 8-104922). Other such steels and methods of manufacturing the same have been roposed wherein the strength and toughness are enhanced by increasing Mn content and refinement of the microstructure {European Patent Applications: EP 0753596A1 (WO 96/23083) and EP 0757113A1 (WO 96/23909)}.

However, the above-described steels and methods involve the following problems. The former method, which utilizes Cu precipitation hardening, imparts both high strength and excellent field weldability to steel, but due to the presence of Cu precipitates (ϵ-Cu phase) dispersed within the steel matrix, is generally ineffective at imparting sufficient toughness to the steel. Also, when the latter high-tensile-strength steel, which contains Mn in excess of 1 wt. %, is manufactured by the continuous casting process (the CC process), impairment in toughness at the center of thickness of a steel plate tends to occur due to centerline segregation. Steel that cannot be manufactured through the continuous casting process, i.e., steel whose slab must be manufactured through ingot making and blooming, tends to have significantly lower yield than that manufactured through the continuous casting process. Steel prepared through the ingot making process is not desirable for mass-production for use in making line pipes due to the expense associated with the ingot making process.

Furthermore, as is disclosed in U.S. Pat. Nos. 5,545,269, 5,545,270 and 5,531,842, of Koo and Luton, it has been found to be practical to produce superior strength steels having yield strengths of at least about 830 MPa (120 ksi) and tensile strengths of at least about 900 MPa (130 ksi), as precursors to linepipe. The strengths of the steels described by Koo and Luton in U.S. Pat. No. 5,545,269 are achieved by a balance between steel chemistry and processing techniques whereby a substantially uniform microstructure is produced that comprises primarily fine-grained, tempered martensite and bainite which are secondarily hardened by precipitates of ϵ-copper and certain carbides or nitrides or carbonitrides of vanadium, niobium and molybdenum.

In U.S. Pat. No. 5,545,269, Koo and Luton describe a method of making high strength steel wherein the steel is quenched from the finish hot rolling temperature to a temperature no higher than 400° C. (752° F.) at a rate of at least 20° C./second (36° F./second), preferably about 30° C./second (54° F./second), to produce primarily martensite and bainite microstructures. Furthermore, for the attainment of the desired microstructure and properties, the invention by Koo and Luton requires that the steel plate be subjected to a secondary hardening procedure by an additional processing step involving the tempering of the water cooled plate at a temperature no higher than the $Ac_1$ transformation point, i.e., the temperature at which austenite begins to form during heating, for a period of time sufficient to cause the precipitation of ϵ-copper and certain carbides or nitrides or carbonitrides of vanadium, niobium and molybdenum. The additional processing step of post-quench tempering in these steels leads to a yield to tensile strength ratio of over 0.93. From the point of view of preferred pipeline design, it is desirable to keep the yield to tensile strength ratio lower than about 0.93, while maintaining high tensile strengths.

One method for solving these problems is to utilize a high nickel content in the steel. U.S. Pat. No. 5,545,269 includes up to 2 wt. % nickel. However, depending on the carbon content and other alloying elements in the steel, using a high nickel content, e.g., greater than about 1.5 wt. %, can impair weldability in girth welding during pipeline construction; additionally, added nickel increases the alloying cost. Thus, an object of the present invention is to provide high-tensile-strength steel, with a good yield to tensile strength ratio, i.e., less than about 0.93, which can be manufactured by the continuous casting process, and which has excellent through-thickness toughness, excellent properties at welded joints, a TS of at least about 900 MPa (130 ksi), an impact energy at −40° C. (−40° F.) (e.g., a vE at −40° C.) of greater than about 120 J (90 ft-lbs). Further objects of this invention are to provide such steels having good weldability, such as no cracking, and having an impact energy at −20° C. (−4° F.) (e.g., a vE at −20° C.) in the heat affected zone (HAZ), or welded joint, of greater than about 70 J (52 ft-lbs).

SUMMARY OF THE INVENTION

In an attempt to obtain high-tensile-strength steel having a tensile strength (TS) of at least about 900 MPa (130 ksi) and excellent through-thickness toughness, even when a slab thereof is manufactured by the continuous casting process, the inventors of the present invention have studied a number of steels having different compositions and have confirmed the following.

When high-tensile-strength steel with Mn content of at least about 1 wt. % is manufactured through the continuous casting process, limiting the value of Vs expressed by equation {1} below to not greater than about 0.42, tends to significantly reduce centerline segregation. Consequently, toughness at the center of wall thickness is greatly improved. When the Mn content is less than about 1.7 wt. %, the above limitation of the Vs value is particularly effective.

$$Vs=C+(Mn/5)+5P-(Ni/10)-(Mo/15)+(Cu/10) \quad \{1\}$$

wherein each atomic symbol represents its content in (wt. %).

The occurrence of brittle fracture requires the presence of a defect serving as an initiation site of brittle fracture. As the TS of steel increases, the critical size of the defect required to initiate brittle fracture generally decreases. Carbides, such as cementite, that are well dispersed in steel are essential for dispersion hardening, but they can be considered as a kind of defect from the viewpoint of brittle fracture, since they are themselves very hard and brittle. Accordingly, for high-tensile-strength steel, the size of the carbides is preferably limited to a certain level. The onset of brittle fracture is determined by the maximum size rather than the average size of the carbides. That is, the carbide having the maximum size serves as an initiation site for brittle fracture. Although the average size of carbides is related to the maximum size, it is important to specify the maximum carbide size in order to control the toughness of the steel.

The specification of the maximum size of the carbides is applicable not only to the center of plate thickness but also to the remaining portion of plate thickness. Nevertheless, the more important specification is for the center, or substantially the center, of plate thickness, where C, Mn, and the like tend to concentrate.

High-tensile-strength steel having better balanced toughness and strength can be obtained through implementation of the following microstructure condition: a mixed structure of martensite and bainite occupies at least 90 vol.% in the entire microstructure; lower bainite occupies at least 2 vol. % in the mixed structure; and the aspect ratio (as defined herein) of the prior austenite grains is adjusted to be at least to about 3. As used in this description and in the claims, the aspect ratio of an austenite grain in the non-recrystallized state, a prior austenite grain, is defined as follows: aspect ratio=the diameter (length) of an elongated grain in the rolling direction divided by the diameter (breadth) of the austenite grain as measured in the direction of plate thickness.

The gist of the present invention is to provide the following high-tensile-strength steel and the following method of manufacturing the same.

(1) A high-tensile-strength steel having a tensile strength of at least about 900 MPa (130 ksi) and having the following composition based on % by weight: carbon (C): about 0.02% to about 0.1%; silicon (Si): not greater than about 0.6%; manganese (Mn): about 0.2% to about 2.5%; nickel (Ni): about 0.2% to about 1.2%; niobium (Nb): about 0.01% to about 0.1%; titanium (Ti): about 0.005% to about 0.03%; aluminum (Al): not greater than about 0.1%; nitrogen (N): about 0.001% to about 0.006%; copper (Cu): 0% to about 0.6%; chromium (Cr): 0% to about 0.8%; molybdenum (Mo): 0% to about 0.6%; vanadium (V): 0% to about 0.1%; boron (B): 0% to about 0.0025%; and calcium (Ca): 0% to about 0.006%; the value of Vs as defined by equation {1} below being preferably from about 0.15, more preferably from about 0.28, to about 0.42; phosphorous (P) and sulfur (S) among impurities being contained in an amount of not greater than about 0.015 wt. % and not greater than about 0.003 wt. %, respectively, and carbide in the steel having a size of not ater than about 5 $\mu$m in the longitudinal direction.

$$Vs=C+(Mn/5)+5P-(Ni/10)-(Mo/15)+(Cu/10) \quad \{1\}$$

wherein each atomic symbol represents its content in (wt. %).

(2) A high-tensile-strength steel as described in (1) above, wherein the microstructure satisfies the following condition (a).

(a) A mixed structure that substantially comprises martensite and lower bainite occupies at least about 90 vol. % in the microstructure; the lower bainite occupies at least about 2 vol. % in the mixed structure; and the aspect ratio of prior austenite grains is at least about 3.

(3) A high-tensile-strength steel as described in (1) above, wherein the value of Ceq as defined by equation {2} below is about 0.4 to about 0.7.

$$Ceq=C+(Mn/6)+\{(Cu+Ni)/15)+(Cr+Mo+V)/5\} \quad \{2\}$$

wherein each atomic symbol represents its content in (wt. %)

(4) A high-tensile-strength steel as described in (1) above, wherein the microstructure satisfies the following condition (a), and the value of Ceq is about 0.4 to about 0.7.

(a) A mixed structure that substantially comprises martensite and lower bainite occupies at least about 90 vol. % in the microstructure; the lower bainite occupies at least about 2 vol. % in the mixed structure; and the aspect ratio of prior austenite is at least about 3.

(5) An essentially boron-free high-tensile-strength steel as described in (1) above, wherein the manganese content is from about 0.2 wt. % to about 1.7 wt. %, preferably not including 1.7 wt. %, and boron content is from 0 wt. % to about 0.0003 wt. %.

(6) An essentially boron-free high-tensile-strength steel as described in (2) above, wherein the manganese content is from about 0.2 wt. % to about 1.7 wt. %, preferably not including 1.7 wt. %, and the boron content is from 0 wt. % to about 0.0003 wt. %.

(7) An essentially boron-free high-tensile-strength steel as described in (3) above, wherein the manganese content is from about 0.2 wt. % to about 1.7 wt. %, preferably not including 1.7 wt. %, the boron content is from 0 wt. % to about 0.0003 wt. %, and the value of Ceq is from about 0.53 to about 0.7.

(8) An essentially boron-free high-tensile-strength steel as described in (4) above, wherein the manganese content is from about 0.2 wt. % to about 1.7 wt. %, preferably not including 1.7 wt. %, the boron content is from 0 wt. % to about 0.0003 wt. %, and the value of Ceq is from about 0.53 to about 0.7.

(9) A high-tensile-strength steel as described in (1) above, wherein the manganese content is from about 0.2 wt. % to about 1.7 wt. %, preferably not including 1.7 wt. %, and the boron content is from about 0.0003 wt. % to about 0.0025 wt. %.

(10) A high-tensile-strength steel as described in (2) above, wherein the manganese content is from about 0.2 wt. % to about 1.7 wt. %, preferably not including 1.7 wt. %, and the boron content is from about 0.0003 wt. % to about 0.0025 wt. %.

(11) A high-tensile-strength steel as described in (3) above, wherein the manganese content is from about 0.2 wt. % to about 1.7 wt. %, preferably not including 1.7 wt. %, the boron content is from about 0.0003 Wt.% to about 0.0025 wt. %, and the value of Ceq is from about 0.4 to about 0.58.

(12) A high-tensile-strength steel as described in (4) above, wherein the manganese content is from about 0.2 wt. % to about 1.7 wt. %, preferably not including 1.7 wt. %, the boron content is from about 0.0003 wt. % to about 0.0025 wt. %, and the value of Ceq is from about 0.4 to about 0.58.

(13) A method of manufacturing a high-tensile-strength steel plate having a chemical composition as described in any of (1), (2), (3), (4), (5), (6), (7), (8), (9), (10), (11), or (12)-above, comprises the steps of: heating a steel slab to a temperature of about 950° C. (1742° F.) to about 1250° C. (2282° F.); hot rolling the steel slab under the condition that the accumulated reduction ratio at a temperature of not higher than about 950° C. (1742° F.) is at least about 25%; completing the hot rolling at a temperature of not lower than about the $Ar_3$ transformation temperature (i.e., the temperature at which austenite begins to transform to ferrite during cooling) or about 700° C. (1292° F.), whichever is higher; and cooling the hot-rolled steel plate from a temperature of not lower than about 700° C. (1292° F.) at a cooling rate of about 10° C./sec to about 45° C./sec (about 18° F./sec to about 81° F./sec) as measured at the center, or substantially the center, of the steel plate until the center, or substantially the center, is cooled to a temperature of about 450° C. (842° F.) or below.

(14) A method of manufacturing a high-tensile-strength steel plate as described in (13) above, further including a step of tempering the rolled steel plate at a temperature of not higher than about 675° C. (1247° F.).

The above-described steel according to the present invention is conceived to be manufactured primarily through the continuous casting process, but may be manufactured through the ingot making process. Accordingly as used in this description and in the claims, the "steel slab" may be a continuously cast steel slab or a slab obtained by blooming an ingot.

The above-described steel may contain not only alloy components in the above-described ranges of content but also known trace elements in order to obtain relevant effects that are normally obtained by the presence of such trace elements. For example, in order to control the shape of inclusion and improve toughness of a welding heat affect zone (HAZ), trace rare earth elements or the like may be contained.

In one embodiment "carbides" may be observed by viewing an extracted replica of the steel microstructure through an electron microscope. As used herein, the "size in the longitudinal direction" refers to the "longest diameter" of the maximum carbide among all carbides observed within an approximately 2000-magnification field of view of an electron microscope. As used in this description and in the claims, "carbide size" represents an average value of the size in the longitudinal direction of the maximum carbides observed in approximately 10 fields of extracted replica measured by electron microscope with an approximately 2000-magnification. This carbide size, or average value of the maximum carbide, or the average maximum size in the longitudinal direction, as measured at each of: the center, or substantially the center, of plate thickness, ¼ of plate thickness, and a surface layer, preferably falls within the aforementioned range.

When the aforementioned microstructure contains residual austenite as a structure other than martensite and lower bainite, the volume percentage of residual austenite can be obtained by X-ray diffraction. Further phases other than martensite and lower bainite, for example, upper bainite and pearlite, can be differentiated from the aforementioned mixed structure by observing a metal etched with picral through an optical microscope. Also, since carbide has a morphological feature in each of these structures, carbide can be identified by observing a carbide-extracted replica through an electron microscope at approximately 2000-magnification. When such identification is difficult to obtain by the above-mentioned methods, a thin specimen may be observed through a transmission electron microscope in order to obtain such identification. Because this method involves observation at a high magnification, a reasonable result can be obtained through observing a number of fields of view, e.g., about 10 or more.

To measure the volume percentage of lower bainite in a mixed structure of martensite and lower bainite, as described above, a carbide-extracted replica or a thin specimen can be observed through an electron microscope. According to another method, a simulated continuous cooling transformation diagram with deformation can be applied to the steel under testing. This diagram may be obtained by using the working Formaster test machine, and the volume percentage of the mixed microstructure or-lower bainite may be accurately measured for individual cooling rates. This enables a highly accurate estimation of microstructure according to an actual working ratio and cooling rate of the steel.

As used in this description and in the claims "steel" primarily refers to a steel plate, particularly a thick steel plate, but may be hot rolled steel, forged materials, or the like.

DESCRIPTION OF ATTACHED DATA TABLES

The advantages of the present invention will be better understood by referring to the following detailed description and the attached data tables in which:

Table 1 shows contents of major elements in steels tested in Test 1 of the EXAMPLES;

Table 2 shows contents of optional elements and impurity elements, P and S, in steels tested in Test 1 of the EXAMPLES;

Table 3 shows hot rolling, cooling, and tempering conditions of steels in test 1 of the EXAMPLES;

Table 4 shows the performance of steel in Test 1 in the EXAMPLES;

Table 5 shows contents of some elements in steels tested in Test 2 of the EXAMPLES;

Table 6 shows contents of additional elements in steels tested in Test 2 of the EXAMPLES;

Table 7 shows hot rolling, cooling, and tempering conditions of steels tested in Test 2 of the EXAMPLES;

Table 8 shows the microstructure of steels tested in Test 2 of the EXAMPLES; and Table 9 shows the performance of steels tested in Test 2 of the EXAMPLES.

While the invention will be described in connection with its preferred embodiments, it will be understood that the invention is not limited thereto. On the contrary, the invention is intended to cover all alternatives, modifications, and equivalents that may be included within the spirit and scope of the invention, as defined by the appended claims.

DETAILED DESCRIPTION OF THE INVENTION

The reason for the above-described limitations on the present invention will now be described. In the following description, "%" accompanying an alloy element refers to "wt. %."

1. Chemical Composition

C: 0.02% to 0.1%

Carbon is effective for increasing strength of steels. In order for steels of the present invention to obtain a desired strength, the carbon content must be at least about 0.02%. However, if the carbon content exceeds about 0.1%, carbides can become coarse, resulting in an impairment in toughness of the steel and an increased susceptibility to cold cracking during on-site fabrication. Therefore, the upper limit of the carbon content is preferably about 0.1%.

Si: Not greater than 0.6%

Silicon is added primarily for the purpose of deoxidization. The amount of Si remaining in steel after deoxidization may be substantially 0%. However, if the silicon content prior to deoxidization is substantially 0%, the loss of Al during deoxidization increases. Accordingly, the silicon content is preferably sufficient to provide residual Si for consumption during deoxidization. A lower limit of about 0.01% Si is sufficient to adequately minimize loss of Al during deoxidization. Another consideration is that if Si remains in the steel after deoxidization in an amount exceeding about 0.6%, production of a fine dispersion of carbides during tempering can be impeded, resulting in a reduction in steel toughness. In addition, silicon content exceeding about 0.6% can result in a reduction in HAZ toughness and an impairment in formability. Therefore, the upper limit of the silicon content is determined to be about 0.6%, more preferably about 0.4%.

Mn: 0.2% to 2.5%

Manganese is an effective element for increasing strength of steels according to this invention since it contributes strongly to hardenability. If the manganese content is less than about 0.2%, the effect on hardenability is weak. For the high-tensile-strength steels of the present invention Mn content is preferably at least about 0.2%. If the manganese content exceeds about 2.5%, centerline segregation during casting can be accelerated, which leads to a reduction of toughness. Accordingly, for high-tensile-strength steel having a TS of at least about 900 MPa (130 ksi), Mn content is preferably less than or equal to about 2.5%. Moreover, if the manganese content is limited to less than about 1.7%, centerline segregation is reduced by controlling the Vs value as defined herein. Restricting the Mn content to less than about 1.7% provides an effective restraint on delayed fracture during welding. It also minimizes centerline segregation during continuous casting. Restricting the manganese content to less than about 1.7% tends to provide enhanced toughness in the high-tensile-strength steels of this invention.

Ni: 0.2% to 1.2%

Nickel is effective for increasing strength while also improving toughness. Ni is particularly effective in improving crack arrestability. Nickel also acts to counteract the deleterious effects of Cu, when present, which can cause surface cracking during hot rolling. Accordingly, the nickel content is preferably at least about 0.2%. However, if the nickel content exceeds about 1.2%, the toughness of girth welds can be reduced during construction of pipelines made from linepipes formed from the high-tensile-strength steels according to this invention. Accordingly, the upper limit of the nickel content is preferably about 1.2%.

Nb: 0.01%to0.1%

Niobium is an effective element for refining austenite (hereafter referred to as "γ") grains during controlled rolling. To this end, the niobium content is preferably at east about 0.01%. However, if the niobium content is in excess of 0.1%, weldability during on-site fabrication can be significantly impaired and toughness decreases. Therefore, the upper limit of the niobium content is preferably about 0.1%.

Ti: 0.005% to 0.03%

Titanium is effective for refining y grains during reheating of a slab and is thus preferably contained in an amount of not less than about 0.005%. In the presence of niobium, Ti is particularly effective at inhibiting the formation of cracks in the surface of continuously cast slabs. If the titanium content is in excess of 0.03%, however, TiN particles tend to coarsen, which can lead to austenite grain growth. Accordingly, the upper limit of the titanium content is preferably about 0.03%, more preferably about 0.018%.

Al: not greater than 0.1%

Aluminum is normally added as a deoxidizer. When Al remains in steel in a form other than oxide, Al and N tend to combine to precipitate AIN, preventing the growth of γ grains and thereby refining microstructure. Accordingly, Al is also useful for improvement of toughness of the steel. To attain this effect, Al is preferably contained in an amount of at least about 0.005%. Since excess Al can cause the coarsening of inclusions, which in turn can reduce toughness of the steel, the upper limit of the aluminum content is preferably about 0.1%, more preferably about 0.075%. Herein, Al is not limited to acid-soluble Al, but includes acid-insoluble Al such as that in the form of oxides.

N: 0.001% to 0.006%

Nitrogen, together with Ti, tend to form TiN, which inhibits γ grain coarsening during slab reheating and welding. To obtain such an effect, N is preferably contained in an amount of at least about 0.001%. N in an amount greater than about 0.001% can lead to an increased amount of dissolved N in the steel, which tends to impair slab quality and reduce HAZ toughness. Therefore, the upper limit of the nitrogen content is preferably about 0.006%.

Next, optional elements will be described.

Cu: 0% to 0.6%

Steels according to the present invention can be prepared without added copper. However, since Cu tends to enhance strength without significantly impairing toughness, Cu is added, as needed, for the purpose of increasing strength while maintaining resistance to weld cracking. Copper content of less than about 0.2% is substantially ineffective for increasing strength. Accordingly, when Cu is to be added, the copper content is preferably at least about 0.2%. However, copper content greater than about 0.6%, tends to sharply decrease toughness. Therefore, the upper limit of the copper content is preferably about 0.6%. More preferably, the copper content ranges from about 0.3% to about 0.5%.

Cr: 0% to 0.8%

Steels according to the present invention can be prepared without added chromium. However, since Cr is effective for increasing strength, Cr is added, as needed, for the purpose of obtaining high strength. Chromium content of less than about 0.2% is substantially ineffective for increasing strength. Accordingly, when Cr is added, the chromium content is preferably not less than about 0.2%. However, if the chromium content greater than about 0.8%, coarse carbides tend to be generated in grain boundaries, resulting in reduced toughness. Therefore, the upper limit of the chromium content is preferably about 0.8%. More preferably, the chromium content ranges from about 0.3% to about 0.7%.

Mo: 0% to 0.6%

Steels according to the present invention can be prepared without added molybdenum. However, since Mo is effective for increasing strength, Mo is added as needed for that purpose. A benefit of adding Mo to increase strength is that carbon content can be reduced, which is advantageous from the viewpoint of weldability. As explained in the discussion of carbon addition, carbon content greater than about 0.1% can cause increased susceptibility to cold cracking during on-site fabrication, i.e., welding. Molybdenum content of less than about 0.1% is substantially ineffective for increasing strength. Accordingly, when Mo is added, the molybdenum content is preferably at least about 0.1%. However, if the molybdenum content is greater than about 0.6%, toughness can be reduced. Accordingly, the molybdenum content is preferably less than about 0.6%. More preferably, the molybdenum content is from about 0.3% to about 0.5%.

V: 0%to0.1%

Steels according to the present invention can be prepared without added vanadium. However, since trace amounts of V can significantly improve strength, V is added as needed for the purpose of obtaining high strength. Vanadium content of less than about 0.01% is substantially ineffective for increasing strength. Accordingly, when V is added, the vanadium content is preferably at least about 0.01%. However, vanadium content of greater than about 0.1% tends to significantly reduce toughness. Accordingly, the upper limit of the vanadium content is preferably about 0.1%.

B: 0% to 0.0025%

Steels according to the present invention can be prepared without added boron. However, even a trace amount of B can significantly enhance the hardenability of steel according to this invention, and can assist in providing the microstructures desired for obtaining improved strength and toughness. Accordingly, B is added particularly when carbon equivalent (Ceq) is to be reduced from the viewpoint of weldability. Boron content of less than about 0.0003% is substantially ineffective for increasing hardenability of steels of this invention. Accordingly, when boron is added, the boron content is preferably at least about 0.0003%. However, if the boron content is greater than about 0.0025%, the size of $M_{23}$ (C, B)$_6$ particles generated at grain boundaries increases, which tends to significantly reduce toughness. M in $M_{23}$(C, B)$_6$ refers to metallic ions such as Fe, Cr, or the like. Accordingly, the upper limit of boron content is preferably 0.0025%. More preferably, the boron content is about 0.0003% to about 0.002%.

Ca: 0% to 0.006%

Steels according to the present invention can be prepared without added Ca. However, calcium acts effectively to control the morphology of MnS (manganese sulfide) inclusions, which improves toughness in a direction perpendicular to the rolling direction of the steel. If the calcium content is less than about 0.001%, particularly when the sulfur (S) content is less than about 0.003%, which, as discussed below, is preferred for steels according to this invention, the sulfide shape control effect is weak. Accordingly, when Ca is added, the calcium content is preferably at least about 0.001%. If the calcium content is greater than about 0.006%, the non-metallic inclusions content of the steel increases. These inclusions act as initiation sites for brittle fracture and thus lead to a reduction in toughness. Therefore, the calcium content is preferably less than about 0.006%.

Vs: 0.15 to 0.42

In the present invention, in addition to controlling individual alloying elements as described above, the value of index Vs is also controlled in order to improve centerline segregation. If the Vs value is greater than about 0.42, significant centerline segregation tends to occur in continuously cast slabs. Thus, when high-tensile-strength steel, having a tensile strength (TS) of at least about 900 MPa (130 ksi), is manufactured by the continuous casting process, the central portion of the slab thereof tends to suffer a reduction in toughness. If the Vs value is less than about 0.15, the degree of centerline segregation is small, but a TS of about 900 MPa (130 ksi) cannot be attained. Accordingly, the lower limit of the Vs value is preferably about 0.15, more preferably about 0.28.

Carbon Equivalent (Ceq):

If the Ceq value of the steel as defined by equation {2} as follows: {21}Ceq=C+(Mn/6)+{(Cu+Ni)/15)+(Cr+Mo+V)/5}, is less than about 0.4, a tensile strength (TS) of at least about 900 MPa (130 ksi) is difficult to attain, particularly in the HAZ. Thus, the lower limit for the Ceq value is preferably about 0.4. If the Ceq value is greater than about 0.7, weld cracking due to hydrogen embrittlement is likely to occur. Thus, the upper limit for the Ceq value is preferably about 0.7. For steels with the Ceq value greater than about 0.7, risk of weld cracking due to hydrogen embrittlement can be reduced by use of a weld metal containing less than about 5 ml of hydrogen per 100 g of weld metal, by maintaining surface cleanliness, and by avoiding welding in a high humidity atmosphere, e.g., avoiding welding where the humidity is higher than about 75%, or more particularly, higher than about 80%. When B is substantially contained in the steel, i.e., when the boron content is about 0.0003% to about 0.0025%, an improvement in hardenability is effected; thus, the upper limit of the Ceq value is preferably reduced to about 0.58. If the Ceq value is limited to less than about 0.4%, a TS of at least about 900 MPa is difficult to attain, as mentioned above. If the Ceq value is in excess of about 0.58, resistance to weld cracking is substantially reduced. When the steel is substantially boron-free, i.e., when the boron content is 0% (inclusive) to about 0.0003% (exclusive), a Ceq value of about 0.53 to about 0.7 is preferred. If the Ceq value is less than about 0.53, a TS of at least about 900 MPa is difficult to attain at the center of thickness of an ordinary steel plate for linepipe use, whereas if the Ceq value is in excess of about 0.7, weld cracking due to hydrogen embrittlement is likely to occur, as mentioned above.

P: not greater than 0.015%

For steel prepared according to the present invention, a phosphorus content greater than about 0.015% tends to cause centerline segregation in slab and segregation at grain boundaries, leading to intergranular embrittlement. Accordingly, the phosphorus content is preferably less than about 0.015%, and more preferably less than about 0.008%.

S: not greater than 0.003%

S precipitates in steel in the form of MnS inclusions, which are elongated during rolling, particularly in the absence of Ca. These inclusions tend to have an adverse effect on toughness of the steel. To avoid excessive inclusion content, the sulfur content is preferably less than about 0.003%. More preferably, the sulfur content is less than about 0.0015%.

Impurity elements other than P and S may be contained within ordinary ranges of content. Minimized impurity content is preferred.

Steels prepared according to the present invention may contain other alloying elements, for the purpose of obtaining the effect normally expected from adding any such alloying element, without departing from the spirit and scope of the present invention.

2. Microstructure (a) Carbide

The carbides contained in steels prepared according to the present invention primarily include cementite ($Fe_3C$) and $M_{23}$(C, B)$_6$. As discussed above, the symbol "M" in $M_{23}$(C, B)$_6$ refers to metallic ions such as Fe, Cr, or the like. When the size of the longer axis of these carbides is longer than about 5 microns, steel toughness is likely to be reduced. Consequently, the desired toughness performance is not attained. Accordingly, the carbide size, as defined herein, or average value of the maximum carbide, or the average maximum size in the longitudinal direction, throughout the plate thickness of steels prepared according to this invention, averaged over at least 10 different fields of view, is preferably less than about 5 microns. The preferred size for the longer axis of carbides in the through-thickness of steels prepared according to this invention can be attained by setting the content of each alloy element such as C, Cr, Mo, B, or the like to an appropriate range and by appropriate processing controls, as described in greater detail herein.

(b) Mixed Structure and Aspect Ratio of Prior γ Grain

In steels prepared according to the present invention, a mixed microstructure of lower bainite and martensite is preferably formed, and the mixed microstructure preferably comprises at least about 90 vol. % of the entire microstructure of the steel. Herein, lower bainite refers to a microstructural constituent where cementite is precipitated within lath-like bainitic ferrite. The reason why this mixed structure provides excellent strength and toughness is that lower bainite, which is generated prior to the generation of martensite, forms a "wall" to divide an austenite grain during cooling. Thereby it restrains the growth of martensite and the coarseness of the martensite packet. The martensite packet size correlates to the units of fracture observed on brittle fracture surfaces. In order to obtain this control of packet size by the lower bainite, the percentage of lower bainite in the mixed microstructure is preferably at least about 2 vol. %. Since the strength of lower bainite is lower than that of martensite, if the percentage of lower bainite is excessively high, the strength of the steel as a whole tends to be reduced. Accordingly, the percentage of lower bainite in the mixed microstructure is preferably less than about 80 vol. %, more preferably less than about 70 vol. %. The desired percentages of mixed microstructure within the entire microstructure and of the lower bainite within the mixed microstructure are preferably met at each of: the center, or substantially the center, of plate thickness, within the quarters of plate thickness nearest the surface layers, and at the surface layers, i.e., throughout the thickness of the steel plate.

In order to achieve the desired toughness of the mixed microstructure of lower bainite and martensite, austenite preferably undergoes sufficient working and is then transformed from the worked and non-recrystallized state. After the working, austenite in the non-recrystallized state preferably has a high density of nucleation sites for lower bainite. Accordingly, the lower bainite is preferably generated from a large number of dispersed nucleation sites present at grain boundaries and within the grains of austenite in the non-recrystallized state. In order to produce such an effect, austenite grains in the non-recrystallized state are preferably sufficiently deformed. The preferred degree of deformation is indicated by an aspect ratio of at least about 3. As used in this description and in the claims, the aspect ratio of an austenite grain in the non-recrystallized state is defined as follows: aspect ratio=the diameter (length) of an elongated grain in the rolling direction divided by the diameter (breadth) of the austenite grain as measured in the direction of plate thickness.

3. Manufacturing Method

When the heating temperature for a steel slab is lower than about 950° C. (1742° F.), the capability of an ordinary rolling mill is generally insufficient to give a sufficient reduction to the steel slab. As a result, a fine structure cannot be obtained through deformation of a cast structure. Accordingly, the heating temperature to be employed is about 950° C. (1742° F.) or higher, preferably about 1000° C. (1832° F.) or higher. If the heating temperature is lower than about 950° C. (1742° F.), solid solution of Nb is generally insufficient. Nb in solid solution restrains recrystallization in the subsequent hot-rolling step. As a result, lack of strength as well as lack of refinement of transformation structure may result due to insufficient precipitation hardening during the process of transformation or during tempering. If the heating temperature is in excess of about 1250° C. (2282° F.), γ grains are coarsened, resulting in reduced toughness, particularly at the centerline of the plate thickness.

In hot rolling, an accumulated reduction ratio of at least about 25% over the temperature range from about 950° C. (1742° F.) or below, to a temperature at which hot rolling ends, is preferred in order to refine the martensite phase and the lower bainite phase which are generated in the subsequent cooling step. An accumulated reduction ratio of at least about 50% over the temperature range from about 950° C. (1742° F.) or below, to a temperature at which hot rolling ends, is more preferred. At a temperature of about 950° C. (1742° F.), a delay in recrystallization of Nb-containing steel becomes noticeable. Through rolling in the non-recrystallization temperature zone not higher than about 950° C. (1742° F.), the effect of working can be accumulated. "Accumulated reduction ratio" as used herein, for example, in reference to rolling at a temperature not higher than about 950° C. (1742° F.), is defined by the following equation:

The accumulated reduction ratio={(thickness at 950° C. (1742° F.)−finished plate thickness)/thickness at 950° C. (1742° F.)}.

The upper limit of the accumulated reduction ratio is not particularly limited. However, if the accumulated reduction ratio is in excess of about 90%, the shape of steel cannot be sufficiently controlled, causing, for example, poor flatness. Therefore, the accumulated reduction ratio is preferably not greater than about 90%.

A temperature at which rolling ends is preferably not lower than about the $Ar_3$ transformation temperature or 700° C. (1292° F.), whichever is higher. If the temperature is lower than about 700° C. (1292° F.), resistance to deformation of steel increases, causing insufficient shape control during working. The upper limit of the stop rolling temperature is preferably about 850° C. (1562° F.) in order to attain an accumulated reduction ratio of not less than about 25%.

A temperature at which cooling starts is preferably about 700° C. (1292° F.) or higher for the following reason. If the temperature is lower than about 700° C. (1292° F.), the presence of elapsed time between end of rolling and start of cooling causes an impairment in hardenability during subsequent cooling, resulting in a significant reduction in toughness. The upper limit of this temperature is preferably about 850° C. (1562° F.) in order to attain the desired accumulated reduction ratio.

If a cooling rate at the center, or substantially the center, of the steel is limited to less than about 10° C./sec (18° F./sec), the desired microstructure for attainment of a tensile strength (TS) of at least about 900 MPa (130 ksi) and good toughness generally cannot be obtained at the center of plate thickness. That is, upper bainite accompanied by coarse carbides, or the like, is generated; thus, failing to provide the desired maximum carbide size in the longitudinal direction of not greater than about 5 μm. At cooling rates in excess of about 45° C./sec (81° F./sec) at the center of steel, hardening may occur in the vicinity of a surface layer, resulting in reduced toughness of a surface layer. Therefore, the cooling rate at the center, or substantially the center, is preferably about 10° C./sec to about 45° C./sec (about 18° F./sec to about 81° F./sec). However, faster cooling rates up to about 70° C./sec (158° F./sec), more preferably up to about 65° C./sec (149° F./sec), may be employed for steels with chemistries within the range of this invention.

If a temperature at which cooling ends is higher than about 450° C. (842° F.) at the center, or substantially the center, of the steel, the generation of martensite or the like becomes insufficient at the center of plate thickness, resulting in a failure to obtain the desired strength. Thus, the temperature at the center, or substantially the center, of plate thickness when cooling ends is preferably not higher than about 450° C. (842° F.). The lower limit of the temperature may be room temperature. However, if the lower limit of the temperature is lower than about 100° C. (212° F.), dehydrogenation effected by slow cooling that utilizes the internal heat of the steel and warm flattening by a leveler, may become insufficient. Therefore, the lower limit of the temperature is preferably not lower than about 100° C. (212° F.).

After the above-described cooling ends, the rolled steel is preferably atmospherically cooled to room temperature. However, in order to make dehydrogenation-progress for preventing hydrogen from causing defects that are likely to occur in high-tensile-strength steel, it is preferable that the temperature at which cooling ends be higher than room temperature and that after the above-mentioned accelerated cooling, rolled steel be slowly cooled to room temperature. This slow-cooling rate is preferably not greater than about 50° C./minute. Slow cooling may be accomplished by any suitable means, as are known to those skilled in the art, such as by placing an insulating blanket over the steel plate.

In order for steel to be more toughened or more reliably dehydrogenated, tempering is performed at a temperature preferably not higher than about 675° C. (1247° F.). For prevention of defects caused by hydrogen, after the above-mentioned accelerated cooling, rolled steel is preferably heated to a tempering temperature without being cooled to room temperature. The lower limit of the tempering temperature may be lower than about 500° C. (932° F.) so long as tempering is substantially performed. However, if the tempering temperature is lower than about 500° C. (932° F.), good toughness may not be obtained. Thus, the lower limit of the tempering temperature is preferably about 500° C. (932° F.). On the contrary, if the tempering temperature is higher than about 675° C. (1247° F.), coarsening of carbides and a reduction in dislocation density occur, resulting in a failure to attain the desired strength. Therefore, the upper limit of the tempering temperature is preferably about 675° C. (1247° F.).

Steels according to this invention are preferably heated, or reheated, by a suitable means for raising the temperature of substantially the entire slab, preferably the entire slab, to the desired heating temperature, e.g., by placing a steel slab in a furnace for a period of time. The specific heating temperature that should be used for any steel composition within the range of the present invention may be readily determined by a person skilled in the art, either by experiment or by calculation using suitable models. Additionally, the furnace temperature and heating time necessary to raise the temperature of substantially the entire slab, preferably the entire slab, to the desired heating temperature may be readily determined by a person skilled in the art by reference to standard industry publications.

For any steel composition within the range of the present invention, the $Ar_3$ transformation temperature (i.e., the temperature at which austenite begins to transform to ferrite during cooling ), depends on the chemistry of the steel, and more particularly, on the heating temperature before rolling, the carbon concentration, the niobium concentration and the amount of reduction given in the rolling passes. Persons skilled in the art may determine this temperature for each steel composition either by experiment or by model calculation.

The heating, or reheating, temperature applies to substantially the entire steel or steel slab. For temperatures measured at the surface of the steel, the temperature can be measured by use of an optical pyrometer, for example, or by any other device suitable for measuring the surface temperature of steel. The quenching, or cooling, rates referred to herein are those at the center, or substantially at the center, of the steel plate thickness. In one embodiment, during processing of experimental heats of a steel composition according to this invention, a thermocouple is placed at the center, or substantially at the center, of the steel plate thickness for center temperature measurement, while the surface temperature is measured by use of an optical pyrometer. A correlation between center temperature and surface temperature is developed for use during subsequent processing of the same, or substantially the same, steel composition, such that center temperature may be determined via direct measurement of surface temperature. The required temperature and flow rate of the cooling or quenching fluid to accomplish the desired accelerated cooling rate may be determined by one skilled in the art by reference to standard industry publications.

EXAMPLES

The present invention will now be described by way of example.

Test 1:

Tables 1 and 2 show the chemical composition of steels according to the present invention.

A steel plate to be tested was manufactured in the following manner. Steel having the chemical composition shown in Tables 1 and 2 was manufactured in a molten form by an ordinary method. The molten steel was continuously cast by a liquid core-vertical bending type C.C. machine, obtaining a continuously cast steel slab having a thickness of 200 mm. The steel slab was cooled to room temperature. Then, the steel slab was heated again and rolled under various conditions, followed by cooling to thereby obtain a steel plate having a thickness of 25 mm.

Table 3 shows the employed rolling and heat treatment conditions.

A test piece was obtained from the center portion of thickness of each of the thus-obtained steel plates. The test pieces underwent the tensile test (JIS Z 2241, test piece No. 4 according to JIS Z 2201) and the Charpy impact test employing a 2 mm V-notch (JIS Z 2242; test piece No. 4 according to JIS Z 2202).

Also, the weld zone of a welded joint underwent the tensile test and the Charpy impact test. A welded joint for use in the tensile test was formed by conducting 4-layer submerged arc welding (heat input: 4 kJ/mm) on the above-mentioned steel plates having a thickness of 25 mm and edge-prepared to a single V groove. A welded joint for use in the Charpy impact test was formed by conducting 4-layer submerged arc welding (heat input: 4 kJ/mm) on the above-mentioned steel plates having a thickness of 25 mm and edge-prepared to a single bevel groove. Test pieces were obtained from these welded joints. The employed flux and wire for welding were those which were commercially available for use in welding 100 ksi high-tensile-strength steel. A test piece used in the tensile test was test piece No. 1 according to JIS Z 3121. A test piece used in the Charpy impact test was obtained, in accordance with JIS Z 3128, from ½ depth of plate thickness so that a-notch tip coincided with a fusion line as observed in macroscopic etching. A test temperature in the Charpy impact test was −40° C. for the base steel and −20° C. for the weld zone.

In order to evaluate weldability during on-site fabrication, the y-groove restraint cracking test (JIS Z 3158) whose conditions are equivalent to the severest on-site welding conditions was carried out. Using a welding rod designed for welding high-tensile-strength steel, a weld bead was laid without preheating (at an atmospheric temperature of 25° C.). The amount of hydrogen was 1.2 cc/l 100 g as measured by gas chromatography.

Table 4 shows the results of the above-described tests.

In test Nos. X1 to X12 of the Comparative Example, the toughness at the center of plate thickness of base plate and the toughness of a welded joint were low without exception. In some impact test piece of core, the fracture surface showed the trace of cracking caused by center segregation during continuous casting.

In test Nos. X9 and X11, the occurrence of weld cracking was observed.

On the contrary, in test Nos. 1 to 12 of the Examples of the present invention, the base steel showed a TS of at least about 900 MPa (130 ksi) and an absorbed energy of not less than about 200 J (test No. 10 at 198 J is considered to be about 200 J for purposes of this invention), and welded joints showed good strength and toughness. Also, the fracture surfaces of test pieces showed no anomaly derived from continuous casting.

Regarding on-site weldability, even when preheating was not performed, no cracking occurred in the y-groove restraint cracking test.

Test 2:

Tables 5 and 6 show the chemical composition of tested steel plates. The steel plate was manufactured in the following manner. Steels having the chemical composition shown in Tables 5 and 6 were manufactured in a molten form by an ordinary method. The molten steel was then cast. The thus-obtained cast steel was rolled under various conditions, thereby obtaining steel plates having a thickness of 12 to 35 mm.

Table 7 shows rolling and heat treatment conditions. Table 8 shows the microstructure at the center of plate thickness corresponding to each test No.

A test piece was obtained from the center portion of thickness of each of the thus-obtained steel plates (tensile strength test piece: test piece No. 10 according to JIS Z 2201; impact test piece: test piece No. 4 according to JIS Z 2202). The test pieces underwent the tensile test (JIS Z 2241) and the Charpy impact test employing a 2 mmn V-notch (JIS Z 2242). Welded joints were manufactured by submerged arc welding through use of commercial flux and wire for welding. These welded joints underwent the tensile test and the Charpy impact test. In order to evaluate weldability during on-site fabrication, the y-groove restraint cracking test (JIS Z 3158) was carried out through use of a commercial welding rod for SMAW (Shielded Metal Arc Welding: manual welding). Constant hygroscopic conditions were established for welding rods so as to obtain a diffusive hydrogen amount of 1.5 cc/100 g.

Table 9 shows the results of the above-described tests.

In test Nos. 11 and 12 of the Comparative Example, the tested steel had the chemical composition according to the present invention, but showed a low toughness due to lack of an accumulated reduction ratio in the non-recrystallizing temperature zone. In test No. 13, a required TS of core was not obtained due to a low cooling rate. Low toughness resulted in test No. 14 due to an excessively high carbon content, in test No. 15 due to an excessively high silicon content, in test No. 16 due to an excessively high manganese content, in test No. 17 due to an excessively high copper content, in test No. 19 due to an excessively high chromium content, in test No. 20 due to an excessively high molybdenum content, and in test No. 21 due to an excessively high vanadium content. In test No. 18, poor toughness resulted since Ni was not contained. Low toughness resulted in test No. 22 since Nb was not contained, in test No. 23 due to an excessively high niobium content, and in test No. 24 due to an excessively high titanium content. In test No. 25, required strength was not obtained because Ceq was too low for a non-boron steel. Low toughness resulted in test No. 26 due to an excessively high boron content, in test No. 28 due to an excessively high nitrogen content, in test No. 30 due to an excessively high Ceq value, and in test No. 32 due to an excessively high Vs value. In test No. 27, a target toughness was not obtained due to an excessively high aluminum content. A TS of at least 900 MPa was not obtained in test No. 29 due to an excessively low Ceq value. Test No. 31 failed to meet the microstructure requirements of the present invention. Weld cracking occurred in test No. 14 due to an excessively high carbon content, in test No. 30 due to an excessively high Ceq value, and in test No. 32 due to an excessively high Vs value.

In test Nos. 1 to 10 of the Examples of the present invention, a TS of at least 900 MPa and an absorbed energy of at least 120 J at −40° C. were obtained. Also, welded joints showed an absorbed energy of at least 100 J at −20° C. Furthermore, welded joints were free from cracking even when welding was carried out without preheating in the y-groove restraint cracking test whose conditions are equivalent to the severest on-site welding conditions. According to the present invention, high-tensile-strength steel having a TS of at least 900 MPa as measured with a base metal and with a welded joint, an absorbed energy of at least 120 J, and excellent weldability during on-site fabrication can be manufactured even by the continuous casting process. Furthermore, such steels have an impact energy at −20° C. (e.g., a vE at −20° C.) in the heat affected zone (HAZ), or welded joint, of greater than about 70 J (52 ft-lbs). As a result, pipelines having a high running pressure can be constructed at low cost without reduction in welding efficiency. Thus, the present invention contributes to an improvement in efficiency of transportation through pipelines.

While steels processed according to the method of the present invention are suited for linepipe applications, the use of such steels is not limited to linepipe applications. Such steels may be suitable for other applications, such as various pressure vessels, and the like.

TABLE 1

| Test No. | Chemical compositions (1) (wt %) C | Si | Mn | Ni | Nb | Ti | Al | N | Vs |
|---|---|---|---|---|---|---|---|---|---|
| Examples of this invention | | | | | | | | | |
| 1 | 0.080 | 0.31 | 1.46 | 0.60 | 0.03 | 0.012 | 0.038 | 0.0041 | 0.33 |
| 2 | 0.081 | 0.32 | 1.46 | 0.59 | 0.02 | 0.012 | 0.057 | 0.0037 | 0.32 |
| 3 | 0.088 | 0.32 | 1.45 | 0.61 | 0.03 | 0.012 | 0.086 | 0.0039 | 0.35 |
| 4 | 0.077 | 0.09 | 1.20 | 0.55 | 0.05 | 0.012 | 0.058 | 0.0046 | 0.31 |
| 5 | 0.082 | 0.33 | 1.22 | 0.61 | 0.05 | 0.012 | 0.090 | 0.0043 | 0.32 |
| 6 | 0.070 | 0.45 | 1.90 | 0.65 | 0.02 | 0.012 | 0.041 | 0.0044 | 0.41 |
| 7 | 0.081 | 0.06 | 1.52 | 0.88 | 0.02 | 0.012 | 0.037 | 0.0042 | 0.35 |
| 8 | 0.069 | 0.31 | 2.24 | 1.15 | 0.02 | 0.012 | 0.052 | 0.0038 | 0.40 |
| 9 | 0.071 | 0.22 | 1.55 | 0.88 | 0.02 | 0.012 | 0.048 | 0.0033 | 0.33 |
| 10 | 0.072 | 0.35 | 1.45 | 0.65 | 0.02 | 0.012 | 0.070 | 0.0042 | 0.35 |
| 11 | 0.080 | 0.44 | 1.54 | 0.66 | 0.02 | 0.012 | 0.037 | 0.0042 | 0.35 |
| 12 | 0.081 | 0.12 | 1.58 | 0.85 | 0.03 | 0.012 | 0.070 | 0.0034 | 0.40 |
| Examples for comparing | | | | | | | | | |
| X1 | *0.120 | 0.31 | 1.46 | 0.61 | 0.03 | 0.012 | 0.039 | 0.0046 | 0.38 |
| X2 | 0.081 | *0.88 | 1.46 | 0.61 | 0.02 | 0.012 | 0.024 | 0.0044 | 0.34 |
| X3 | 0.088 | 0.22 | *2.82 | 0.59 | 0.03 | 0.012 | 0.046 | 0.0045 | *0.61 |
| X4 | 0.077 | 0.09 | 1.20 | 0.55 | 0.05 | 0.012 | 0.038 | 0.0045 | 0.41 |
| X5 | 0.082 | 0.33 | 1.22 | *— | 0.05 | 0.012 | 0.023 | 0.0043 | 0.36 |
| X6 | 0.080 | 0.45 | 0.86 | 0.65 | 0.02 | 0.012 | 0.048 | 0.0041 | 0.20 |
| X7 | 0.081 | 0.06 | 1.21 | 0.65 | 0.02 | 0.012 | 0.043 | 0.0044 | 0.26 |
| X8 | 0.079 | 0.31 | 1.19 | 0.89 | 0.02 | 0.012 | 0.051 | 0.0047 | 0.28 |
| X9 | 0.082 | 0.35 | 1.45 | 0.91 | 0.02 | *0.132 | 0.060 | 0.0044 | 0.33 |
| X10 | 0.062 | 0.21 | 1.22 | 0.56 | *0.008 | 0.012 | 0.021 | 0.0041 | 0.30 |
| X11 | 0.081 | 0.12 | 1.59 | 0.32 | 0.03 | 0.012 | 0.038 | 0.0041 | *0.45 |
| X12 | 0.081 | 0.12 | 1.41 | 0.41 | 0.03 | 0.012 | 0.046 | 0.0042 | *0.44 |

Mark * attached to a numerical value indicates it is out of the preferred range of this invention.

TABLE 2

| Test No. | Chemical composition (2) (bal. Fe:wt %) Cu | Cr | Mo | V | B | Ca | P | S |
|---|---|---|---|---|---|---|---|---|
| Examples of this invention | | | | | | | | |
| 1 | — | — | 0.51 | — | 0.001 | — | 0.011 | 0.001 |
| 2 | — | — | 0.51 | — | 0.001 | — | 0.009 | 0.002 |
| 3 | — | — | 0.49 | — | 0.001 | — | 0.012 | 0.001 |
| 4 | 0.23 | 0.42 | 0.12 | 0.04 | 0.001 | 0.003 | 0.013 | 0.002 |
| 5 | 0.31 | 0.31 | 0.47 | 0.05 | 0.001 | — | 0.011 | 0.001 |
| 6 | — | 0.28 | 0.46 | 0.03 | 0.001 | — | 0.011 | 0.002 |
| 7 | 0.32 | 0.28 | 0.51 | 0.03 | — | 0.003 | 0.011 | 0.001 |
| 8 | — | 0.29 | 0.47 | 0.03 | — | 0.004 | 0.008 | 0.001 |
| 9 | 0.28 | 0.41 | 0.38 | 0.03 | — | — | 0.007 | 0.001 |
| 10 | 0.31 | 0.31 | 0.44 | 0.03 | — | — | 0.011 | 0.001 |
| 11 | 0.21 | 0.31 | 0.45 | 0.04 | — | — | 0.009 | 0.001 |
| 12 | 0.54 | — | 0.41 | — | — | 0.002 | 0.012 | 0.001 |
| Examples for comparing | | | | | | | | |
| X1 | — | — | 0.51 | — | 0.001 | — | 0.013 | 0.002 |
| X2 | — | — | 0.51 | — | 0.001 | — | 0.012 | 0.001 |
| X3 | — | — | 0.49 | — | — | 0.003 | 0.013 | 0.001 |
| X4 | *1.15 | 0.42 | 0.12 | 0.04 | 0.001 | — | 0.008 | 0.002 |
| X5 | 0.31 | 0.31 | 0.47 | 0.05 | 0.001 | — | 0.007 | 0.002 |
| X6 | — | *0.89 | 0.46 | 0.03 | — | 0.004 | 0.008 | 0.001 |
| X7 | — | 0.28 | *0.64 | 0.03 | 0.001 | 0.003 | 0.009 | 0.001 |
| X8 | 0.33 | 0.29 | 0.47 | *0.12 | 0.001 | — | 0.010 | 0.001 |

TABLE 2-continued

| Test | Chemical composition (2) (bal. Fe:wt %) | | | | | | | |
|---|---|---|---|---|---|---|---|---|
| No. | Cu | Cr | Mo | V | B | Ca | P | S |
| X9 | 0.31 | 0.31 | 0.44 | 0.03 | 0.001 | — | 0.009 | 0.002 |
| X10 | 0.21 | 0.31 | 0.45 | 0.04 | 0.001 | — | 0.011 | 0.002 |
| X11 | 0.59 | 0.48 | *0.62 | 0.01 | — | 0.003 | 0.013 | 0.002 |
| X12 | 0.21 | 0.21 | 0.25 | 0.01 | — | — | 0.012 | 0.002 |

Mark * attached to a numerical value indicates it is out of the preferred range of this invention

TABLE 3

| Symbol for a themo-mechanical controlling process (TMCP) | A | B | C | D |
|---|---|---|---|---|
| Rolling | | | | |
| heat temp. (° C.) | 1160 | 1180 | 1140 | 1160 |
| cumulative reduction ratio (%) | 50 | 66 | 50 | 66 |
| finishing temp. (° C.) | 800 | 760 | 780 | 800 |
| Cooling | | | | |
| start temp. (° C.) | 760 | 730 | 740 | 760 |

TABLE 3-continued

| Symbol for a themo-mechanical controlling process (TMCP) | A | B | C | D |
|---|---|---|---|---|
| cooling rate (° C./s) | 50 | 35 | 25 | 35 |
| stop temp. (° C.) | 350 | 270 | 150 | 300 |
| Temper. heat temp. (° C.) | 600 | 600 | 600 | — |

TABLE 4

| Test No. | Symbol for TMCP | Average longer dia. of carbides (μm) | Base steel Tensile test YS (MPa) | Base steel Tensile test TS (MPa) | Base steel Charpy test vE-40 (J) | Welded joint Tensile test TS (MPa) | Welded joint Charpy test vE-20 (J) | Field weldability y-groove crack test (no preheat) |
|---|---|---|---|---|---|---|---|---|
| Examples of this invention | | | | | | | | |
| 1 | A | 3.7 | 860 | 947 | 251 | 929 | 211 | No crack |
| 2 | B | 3.4 | 857 | 944 | 252 | 977 | 146 | No crack |
| 3 | C | 1.6 | 862 | 948 | 255 | 954 | 217 | No crack |
| 4 | D | 4.2 | 843 | 926 | 264 | 939 | 223 | No crack |
| 5 | B | 1.2 | 889 | 983 | 228 | 942 | 179 | No crack |
| 6 | B | 2.4 | 891 | 974 | 226 | 972 | 211 | No crack |
| 7 | C | 2.9 | 908 | 1007 | 219 | 964 | 208 | No crack |
| 8 | A | 3.3 | 932 | 1030 | 221 | 978 | 191 | No crack |
| 9 | A | 1.7 | 901 | 994 | 227 | 972 | 210 | No crack |
| 10 | D | 1.0 | 863 | 956 | 198 | 941 | 192 | No crack |
| 11 | B | 4.6 | 875 | 972 | 203 | 962 | 179 | No crack |
| 12 | C | 3.6 | 862 | 948 | 216 | 951 | 208 | No crack |
| Examples for comparing | | | | | | | | |
| X1 | C | 3.5 | 891 | 983 | *72 | 911 | *62 | No crack |
| X2 | D | 2.1 | 859 | 941 | *81 | *877 | *58 | No crack |
| X3 | D | 1.0 | 852 | 942 | *79 | 908 | *61 | No crack |
| X4 | A | 3.6 | 890 | 976 | *44 | 906 | 166 | No crack |
| X5 | B | 2.8 | 874 | 952 | *26 | *837 | *26 | No crack |
| X6 | B | *5.4 | 866 | 956 | *78 | 916 | 72 | No crack |
| X7 | C | 4.2 | 903 | 993 | *73 | 912 | 94 | No crack |
| X8 | D | 3.8 | 931 | 922 | *57 | 917 | 181 | No crack |
| X9 | D | 3.2 | 953 | 1028 | *41 | 912 | *46 | *crack |

TABLE 4-continued

| Test No. | Symbol for TMCP | Average longer dia. of carbides (μm) | Base steel Tensile test YS (MPa) | Base steel Tensile test TS (MPa) | Base steel Charpy test vE-40 (J) | Welded joint Tensile test TS (MPa) | Welded joint Charpy test vE-20 (J) | Field weldability y-groove crack test (no preheat) |
|---|---|---|---|---|---|---|---|---|
| X10 | A | 2.2 | 772 | *843 | *112 | 915 | *54 | No crack |
| X11 | C | 1.8 | 948 | 1087 | *37 | 944 | *20 | *crack |
| X12 | D | 2.3 | 712 | *807 | *26 | 900 | *31 | No crack |

Mark * attached to a test result indicates it does not attain the aimed level.

TABLE 5

| Steel No. | Chemical composition (1) (wt %) C | Si | Mn | P | S | Cu | Ni | Cr | Mo |
|---|---|---|---|---|---|---|---|---|---|
| Examples of this invention | | | | | | | | | |
| 1 | 0.05 | 0.21 | 1.65 | 0.011 | 0.001 | 0.31 | 0.60 | 0.41 | 0.48 |
| 2 | 0.06 | 0.18 | 1.39 | 0.009 | 0.001 | 0.29 | 0.81 | 0.39 | 0.41 |
| 3 | 0.08 | 0.22 | 1.64 | 0.012 | 0.002 | 0.20 | 0.61 | — | 0.20 |
| 4 | 0.04 | 0.29 | 2.21 | 0.007 | 0.001 | — | 0.60 | — | 0.54 |
| 5 | 0.07 | 0.11 | 1.22 | 0.011 | 0.001 | 0.55 | 0.81 | 0.40 | — |
| 6 | 0.06 | 0.21 | 1.20 | 0.011 | 0.001 | 0.32 | 0.61 | 0.42 | 0.46 |
| 7 | 0.04 | 0.51 | 1.99 | 0.011 | 0.002 | — | 1.15 | — | 0.51 |
| 8 | 0.09 | 0.07 | 0.80 | 0.012 | 0.002 | 0.42 | 0.81 | 0.21 | 0.46 |
| 9 | 0.09 | 0.19 | 0.61 | 0.013 | 0.001 | 0.57 | 0.30 | 0.54 | 0.31 |
| 10 | 0.05 | 0.22 | 1.66 | 0.011 | 0.001 | 0.31 | 0.61 | 0.10 | 0.44 |
| Examples for comparing | | | | | | | | | |
| 51 | *0.12 | 0.21 | 0.60 | 0.012 | 0.001 | 0.61 | 0.29 | 0.53 | 0.30 |
| 52 | 0.05 | *0.69 | 1.75 | 0.011 | 0.002 | — | 1.12 | — | 0.41 |
| 53 | 0.03 | 0.05 | *2.56 | 0.007 | 0.001 | — | 1.18 | — | 0.54 |
| 54 | 0.09 | 0.21 | 0.59 | 0.012 | 0.001 | *0.89 | 0.31 | 0.55 | 0.31 |
| 55 | 0.07 | 0.19 | 1.18 | 0.011 | 0.001 | 0.31 | *— | 0.44 | 0.46 |
| 56 | 0.09 | 0.22 | 0.81 | 0.012 | 0.001 | 0.61 | 0.29 | *0.88 | 0.31 |
| 57 | 0.08 | 0.19 | 1.63 | 0.011 | 0.002 | 0.22 | 0.60 | — | *0.69 |
| 58 | 0.08 | 0.14 | 1.24 | 0.011 | 0.001 | 0.53 | 0.80 | 0.41 | — |
| 59 | 0.08 | 0.21 | 1.41 | 0.011 | 0.001 | 0.55 | 0.81 | 0.40 | — |
| 60 | 0.06 | 0.21 | 1.65 | 0.011 | 0.001 | 0.34 | 0.60 | 0.41 | 0.44 |
| 61 | 0.07 | 0.19 | 1.41 | 0.010 | 0.002 | 0.35 | 0.58 | 0.41 | 0.40 |
| 62 | 0.06 | 0.11 | 1.22 | 0.011 | 0.001 | 0.55 | 0.81 | 0.40 | — |
| 63 | 0.09 | 0.22 | 1.62 | 0.012 | 0.002 | 0.19 | 0.61 | — | 0.22 |
| 64 | 0.09 | 0.21 | 1.40 | 0.012 | 0.002 | 0.20 | 0.41 | 0.40 | *0.64 |
| 65 | 0.09 | 0.19 | 1.59 | 0.012 | 0.001 | — | 0.30 | 0.39 | 0.57 |
| 66 | 0.04 | 0.18 | 0.80 | 0.012 | 0.002 | 0.42 | *0.18 | 0.44 | — |
| 67 | 0.10 | 0.21 | 1.64 | 0.011 | 0.001 | 0.31 | 0.88 | 0.39 | 0.52 |
| 68 | 0.05 | 0.20 | 1.20 | 0.009 | 0.001 | — | 0.81 | 0.39 | 0.41 |
| 69 | 0.09 | 0.22 | 1.64 | 0.012 | 0.002 | 0.40 | 0.22 | — | 0.20 |

Mark * attached to a numerical value indicates it is out of the preferred range of this invention.

TABLE 6

| Steel no. | Chemical composition (2) (wt %:bal. Fe) V | Nb | Ti | B | Al | N | Ca | Ceq | Vs |
|---|---|---|---|---|---|---|---|---|---|
| Examples of this invention | | | | | | | | | |
| 1 | 0.031 | 0.02 | 0.012 | 0.0009 | 0.028 | 0.0041 | — | 0.57 | 0.37 |
| 2 | 0.033 | 0.03 | 0.011 | 0.0012 | 0.047 | 0.0047 | 0.003 | 0.53 | 0.30 |
| 3 | 0.050 | 0.03 | 0.012 | 0.0013 | 0.076 | 0.0042 | — | 0.46 | 0.41 |
| 4 | 0.081 | 0.05 | 0.012 | 0.0018 | 0.048 | 0.0044 | 0.004 | 0.57 | 0.42 |
| 5 | — | 0.02 | 0.013 | 0.0007 | 0.080 | 0.0048 | 0.004 | 0.44 | 0.34 |
| 6 | 0.030 | 0.01 | 0.011 | 0.0014 | 0.031 | 0.0037 | — | 0.50 | 0.30 |
| 7 | 0.032 | 0.07 | 0.010 | 0.0009 | 0.027 | 0.0035 | 0.004 | 0.56 | 0.34 |
| 8 | — | 0.02 | 0.015 | 0.0022 | 0.043 | 0.0044 | — | 0.43 | 0.29 |
| 9 | 0.030 | 0.02 | 0.012 | 0.0010 | 0.038 | 0.0045 | 0.004 | 0.43 | 0.28 |

TABLE 6-continued

| Steel no. | Chemical composition (2) (wt %:bal. Fe) V | Nb | Ti | B | Al | N | Ca | Ceq | Vs |
|---|---|---|---|---|---|---|---|---|---|
| 10 | 0.031 | 0.03 | 0.013 | 0.0011 | 0.061 | 0.0048 | — | 0.50 | 0.38 |
| Examples for comparing | | | | | | | | | |
| 51 | 0.029 | 0.02 | 0.012 | 0.0011 | 0.041 | 0.0033 | — | *0.33 | 0.19 |
| 52 | 0.030 | 0.03 | 0.010 | 0.0009 | 0.027 | 0.0035 | 0.004 | 0.50 | 0.32 |
| 53 | — | 0.05 | 0.012 | 0.0018 | 0.048 | 0.0044 | 0.004 | *0.22 | *−0.09 |
| 54 | 0.033 | 0.02 | 0.012 | 0.0010 | 0.038 | 0.0045 | — | *0.39 | 0.22 |
| 55 | 0.032 | 0.01 | 0.011 | 0.0014 | 0.031 | 0.0037 | — | 0.47 | 0.36 |
| 56 | 0.029 | 0.02 | 0.012 | 0.0010 | 0.038 | 0.0045 | 0.004 | *0.35 | 0.32 |
| 57 | 0.049 | 0.02 | 0.011 | 0.0012 | 0.076 | 0.0042 | — | 0.42 | 0.42 |
| 58 | *0.121 | 0.01 | 0.013 | 0.0008 | 0.080 | 0.0048 | 0.004 | 0.46 | 0.36 |
| 59 | — | *— | 0.013 | 0.0007 | 0.080 | 0.0048 | 0.004 | 0.49 | 0.39 |
| 60 | 0.031 | *0.12 | 0.012 | 0.0009 | 0.028 | 0.0041 | — | 0.57 | 0.39 |
| 61 | 0.031 | 0.02 | *0.035 | 0.0011 | 0.028 | 0.0041 | — | 0.54 | 0.35 |
| 62 | — | 0.02 | 0.013 | — | 0.080 | 0.0048 | 0.004 | *0.43 | 0.33 |
| 63 | 0.046 | 0.03 | 0.012 | *0.0034 | 0.076 | 0.0042 | — | 0.47 | 0.42 |
| 64 | — | 0.02 | 0.015 | 0.0022 | *0.114 | 0.0044 | — | 0.57 | 0.37 |
| 65 | 0.030 | 0.02 | 0.012 | 0.0010 | 0.038 | *0.0078 | 0.004 | 0.57 | 0.40 |
| 66 | 0.033 | 0.02 | 0.015 | 0.0022 | 0.043 | 0.0044 | — | *0.31 | 0.28 |
| 67 | 0.031 | 0.01 | 0.012 | 0.0009 | 0.028 | 0.0041 | — | *0.64 | 0.39 |
| 68 | 0.033 | 0.03 | 0.011 | 0.0012 | 0.047 | 0.0047 | 0.003 | 0.47 | 0.23 |
| 69 | 0.050 | 0.03 | 0.012 | 0.0013 | 0.076 | 0.0042 | — | 0.45 | *0.48 |

Mark * attached to a numerical value indicates it is out of the preferred range of this invention.

TABLE 7

| Symbol for a thermo-mechanical controlling process (TMCP) | A | B | C | D | E | F |
|---|---|---|---|---|---|---|
| Rolling | | | | | | |
| heat temp. (° C.) | 1100 | 1100 | 1150 | 950 | 1150 | 1150 |
| cumulative reduction ratio (%) | 65 | 70 | 80 | 40 | *20 | 70 |
| finishing temp. (° C.) | 750 | 750 | 780 | 740 | 840 | 750 |
| Cooling | | | | | | |
| start temp. (° C.) | 710 | 710 | 740 | 710 | 800 | 710 |
| cooling rate (° C./s) | 27 | 48 | 62 | 29 | 56 | *8 |
| stop temp. (° C.) | 222 | 240 | 320 | 70 | 340 | — |
| Temper. heat temp. (° C.) | — | 610 | — | — | — | — |

Mark * attached to a numerical value indicates it is out of the preferred range of this invention.

TABLE 8

| Test No. | Steel No. | Symbol for TMCP | microstructure of base steel LB + M (vol %) | LB (vol %) | aspect ratio | long dia. carbides (μm) |
|---|---|---|---|---|---|---|
| Examples of this invention | | | | | | |
| 1 | 1 | A | 100 | 20 | 4.3 | 1.8 |
| 2 | 2 | A | 97 | 32 | 3.7 | 2.6 |
| 3 | 3 | A | 92 | 54 | 4.6 | 2.9 |

TABLE 8-continued

| Test No. | Steel No. | Symbol for TMCP | microstructure of base steel LB + M (vol %) | LB (vol %) | aspect ratio | long dia. carbides (μm) |
|---|---|---|---|---|---|---|
| 4 | 4 | B | 100 | 19 | 4.3 | 2.5 |
| 5 | 5 | A | 92 | 58 | 4.2 | 1.9 |
| 6 | 6 | C | 96 | 40 | 4.7 | 2.8 |
| 7 | 7 | D | 99 | 24 | 3.9 | 2.7 |
| 8 | 8 | A | 91 | 61 | 4.2 | 2.6 |
| 9 | 9 | A | 90 | 63 | 4.2 | 2.4 |
| 10 | 10 | B | 95 | 40 | 4.1 | 2.9 |
| Examples for | | | | | | |

TABLE 8-continued

| Test No. | Steel No. | Symbol for TMCP | microstructure of base steel LB + M (vol %) | LB (vol %) | aspect ratio | long dia. carbides (μm) |
|---|---|---|---|---|---|---|
| comparing | | | | | | |
| 11 | 3 | E | 96 | 42 | *2.2 | 2.6 |
| 12 | 6 | E | 98 | 34 | *1.8 | 2.9 |
| 13 | 8 | F | *76 | 82 | 3.7 | *8.8 |
| 14 | 51 | A | 92 | 55 | 3.4 | 2.6 |
| 15 | 52 | A | 96 | 40 | 4.6 | 3.4 |
| 16 | 53 | B | 100 | 5 | 3.7 | 3.3 |
| 17 | 54 | B | 92 | 57 | 3.4 | 2.8 |
| 18 | 55 | A | 94 | 49 | 3.7 | 2.1 |
| 19 | 56 | A | 97 | 32 | 4.1 | 2.9 |
| 20 | 57 | A | 99 | 4 | 4.6 | 2.3 |

TABLE 8-continued

| Test No. | Steel No. | Symbol for TMCP | microstructure of base steel LB + M (vol %) | LB (vol %) | aspect ratio | long dia. carbides (μm) |
|---|---|---|---|---|---|---|
| 21 | 58 | C | 94 | 47 | 4.6 | 2.2 |
| 22 | 59 | A | 94 | 45 | *1.3 | 2.5 |
| 23 | 60 | D | 100 | 19 | 5.1 | 2.6 |
| 24 | 61 | A | 98 | 30 | 3.4 | 2.7 |
| 25 | 62 | A | 91 | 61 | 4.2 | 3.2 |
| 26 | 63 | C | 93 | 22 | 4.6 | 2.5 |
| 27 | 64 | A | 100 | 19 | 4.1 | 2.4 |
| 28 | 65 | A | 100 | 19 | 4.2 | 3.1 |
| 29 | 66 | C | *68 | 26 | 4.1 | *6.2 |
| 30 | 67 | C | 100 | 6 | 4.2 | 3.8 |
| 31 | 68 | A | *54 | 24 | 4.1 | *6.9 |
| 32 | 69 | D | 92 | 21 | 4.0 | 2.9 |

Mark * attached to a numerical value indicates it is out of the preferred range of this invention.

TABLE 9

| Test No. | Steel No. | Symbol for TMCP | Base steel Y S (MPa) | T S (MPa) | vE-40 (J) | Welded joint T S (MPa) | vE-20 (J) | y-groove weld crack test (no preheat) |
|---|---|---|---|---|---|---|---|---|
| Examples of this invention | | | | | | | | |
| 1 | 1 | A | 1067 | 1147 | 136 | 1181 | 102 | No crack |
| 2 | 2 | A | 1010 | 1086 | 144 | 1118 | 108 | No crack |
| 3 | 3 | A | 899 | 967 | 161 | 996 | 121 | No crack |
| 4 | 4 | B | 1070 | 1151 | 136 | 1186 | 102 | No crack |
| 5 | 5 | A | 879 | 945 | 165 | 974 | 124 | No crack |
| 6 | 6 | C | 969 | 1041 | 150 | 1073 | 112 | No crack |
| 7 | 7 | D | 1047 | 1126 | 139 | 1160 | 104 | No crack |
| 8 | 8 | A | 863 | 928 | 168 | 956 | 126 | No crack |
| 9 | 9 | A | 852 | 916 | 170 | 944 | 128 | No crack |
| 10 | 10 | B | 966 | 1039 | 150 | 1070 | 113 | No crack |
| Examples for comparing | | | | | | | | |
| 11 | 3 | *E | 921 | 978 | *81 | 989 | 128 | No crack |
| 12 | 6 | *E | 978 | 1057 | *76 | 1074 | 121 | No crack |
| 13 | 8 | *F | 724 | *786 | 166 | 966 | 124 | No crack |
| 14 | *51 | A | 974 | 1047 | *61 | 1078 | *43 | *Crack |
| 15 | *52 | A | 969 | 1042 | *78 | 1073 | *53 | No crack |
| 16 | *53 | B | 1083 | 1164 | *57 | 1199 | *29 | No crack |
| 17 | *54 | B | 968 | 1041 | *84 | 1072 | *41 | No crack |
| 18 | *55 | A | 923 | 993 | *55 | 1023 | *27 | No crack |
| 19 | *56 | A | 1005 | 1081 | *68 | 1114 | *34 | No crack |
| 20 | *57 | A | 1043 | 1122 | *42 | 1155 | *29 | No crack |
| 21 | *58 | C | 935 | 1005 | *27 | 1036 | *48 | No crack |
| 22 | *59 | A | 941 | 1012 | *97 | 1042 | *54 | No crack |
| 23 | *60 | D | 1072 | 1153 | *46 | 1188 | *32 | No crack |
| 24 | *61 | A | 1015 | *1091 | *53 | 1124 | *29 | No crack |
| 25 | *62 | A | 728 | *783 | 199 | *806 | 149 | No crack |
| 26 | *63 | C | 997 | 1072 | *69 | 1104 | *36 | No crack |
| 27 | *64 | A | 1070 | 1150 | *97 | 1185 | 102 | No crack |
| 28 | *65 | A | 913 | 982 | *87 | 1011 | *12 | No crack |
| 29 | *66 | C | 677 | *728 | 214 | *750 | 161 | No crack |
| 30 | *67 | C | 1086 | 1168 | *72 | 1203 | *41 | *Crack |

TABLE 9-continued

| Test No. | Steel No. | Symbol for TMCP | Base steel Y S (MPa) | Base steel T S (MPa) | Base steel vE-40 (J) | Welded joint T S (MPa) | Welded joint vE-20 (J) | y-groove weld crack test (no preheat) |
|---|---|---|---|---|---|---|---|---|
| 31 | *68 | A | 820 | *882 | 177 | 908 | 133 | No crack |
| 32 | *69 | D | 895 | 962 | *96 | 991 | *52 | *Crack |

Mark * attached to a steel No. or a TMCP symbol indicates it is out of the preferred range of this invention and one attached to a test result shows it does not attain the aimed level.

What is claimed is:

1. A non-tempered steel having a tensile strength of at least about 900 MPa (130 ksi), an impact energy as measured at −40° C. (−40° F.) of greater than about 120 J (90 ft-lbs), and a microstructure comprising a mixed structure of martensite and lower bainite, wherein (i) said mixed structure occupies at least about 90 vol. % in said microstructure, (ii) said lower bainite occupies at least about 2 vol. % in said mixed structure, and (iii) prior austenite grains have an aspect ratio of at least about 3, wherein said steel is produced from a reheated steel slab comprising iron and the following additives in the weight percents indicated:

C: about 0.02% to about 0.1%;

Mn: about 0.2% to less than 1.7%;

Ni: about 0.2% to about 1.2%;

Nb: about 0.01% to about 0.1%;

Ti: about 0.005% to about 0.03%; and

N: about 0.001% to about 0.006%; and other impurities, including

P: not greater than about 0.015%; and

S: not greater than about 0.003%; and wherein said steel has a Vs value, as defined by equation {1} below, of about 0.15 to about 0.42, and further has a carbide size of less than about 5 microns:

$$Vs=C+(Mn/5)+5P-(Ni10)-(Mo/15)+(Cu/10) \quad \{1\}$$

wherein each atomic symbol represents its content in wt. %.

2. The steel of claim 1, wherein said steel has a Vs value of about 0.28 to about 0.42.

3. The steel of claim 1 further comprising 0 wt % to about 0.6 wt % Si, 0 wt % to about 0.1 wt % Al, 0 wt % to about 0.6 wt % Cu, 0 wt % to about 0.8 wt % Cr, 0 wt % to about 0.6 wt % Mo, 0 wt % to about 0.1 wt % V, 0 wt % to about 0.0025 wt % B, and 0 wt % to about 0.006 wt % Ca.

4. The steel of claim 1, further having a Ceq value, as defined by equation {2} below, of about 0.4 to about 0.7:

$$Ceq=C+(Mn/6)+\{(Cu+Ni)/15\}+\{(Cr+Mo+V)/5\} \quad \{2\}$$

wherein each atomic symbol represents its content in wt. %.

5. The steel of claim 1, wherein said steel has a manganese content of about 0.2 wt. % to less than 1.7 wt. %, and a boron content of 0 wt. % to about 0.0003 wt. %.

6. The steel of claim 1, wherein said steel has a manganese content of about 0.2 wt. % to less than 1.7 wt. %, a boron content of 0 wt. % to about 0.0003 wt. %, and a Ceq value, as defined by equation {2} below, of about 0.53 to about 0.7:

$$Ceq=C+(Mn/6)+\{(Cu+Ni)/15\}+\{(Cr+Mo+V)/5\} \quad \{2\}$$

wherein each atomic symbol represents its content in wt. %.

7. The steel of claim 1, wherein said steel has a manganese content of about 0.2 wt. % to less than 1.7 wt. %, and a boron content of about 0.0003 wt. % to about 0.0025 wt. %.

8. The steel of claim 1, wherein said steel has a manganese content of about 0.2 wt. % to less than 1.7 wt. %, a boron content of about 0.0003 wt. % to about 0.0025 wt. %, and a Ceq value, as defined by equation {2} below, of about 0.4 to about 0.58:

$$Ceq=C+(Mn/6)+\{(Cu+Ni)/15\}+\{(Cr+Mo+V)/5\} \quad \{2\}$$

wherein each atomic symbol represents its content in wt. %.

9. A method for preparing a steel plate comprising 0.2 wt % to less than 1.7 wt % Mn and having a tensile strength of at least about 900 MPa (130 ksi), an impact energy as measured at −40° C. (−40° F.) of greater than about 120 J (90 ft-lbs), and a microstructure comprising a mixed structure of martensite and lower bainite, wherein (i) said mixed structure occupies at least about 90 vol. % in said microstructure, (ii) said lower bainite occupies at least about 2 vol. % in said mixed structure, and (iii) prior austenite grains have an aspect ratio of at least about 3, said method comprising the steps of:

(a) heating a steel slab to a temperature of about 950° C. (1742° F.) to about 1250° C. (2282° F.);

(b) hot rolling said steel slab, under the condition that the accumulated reduction ratio at a temperature of not higher than about 950° C. (1742° F.) is at least about 25%, to form steel plate;

(c) completing the hot rolling step at a temperature of not lower than about the $Ar_3$ transformation temperature or about 700° C. (1292° F.), whichever is higher; and (d) cooling said steel plate from a temperature of not lower than about 700° C. (1292° F.) at a cooling rate of about 10° C./sec to about 45° C./sec (about 18° F./sec to about 81° F./sec) as measured at substantially the center of said steel plate until substantially the center of said steel plate is cooled to a temperature of not higher than about 450° C. (842° F.), so as to facilitate completion of transformation of said steel plate to a mixed structure of martensite and lower bainite, wherein (i) said mixed structure occupies at least about 90 vol. % in said microstructure, (ii) said lower bainite occupies at least about 2 vol. % in said mixed structure, and (iii) prior austenite grains have an aspect ratio of at least about 3, having a tensile strength of at least about 900 MPa (130 ksi) and an impact energy as measured at −40° C. (−40° F.) of greater than about 120 J (90 ft-lbs). so as to form the produced steel without tempering.

10. The method of claim 9, wherein said steel plate comprises iron and the following additives in the weight percents indicated:

C: about 0.02% to about 0.1%;

Mn: about 0.2% to less than 1.7%;

Ni: about 0.2% to about 1.2%;

Nb: about 0.01% to about 0.1%;

Ti: about 0.005% to about 0.03%; and

N: about 0.001% to about 0.006%; and other impurities, including

P: not greater than about 0.015%; and

S: not greater than about 0.003%; and wherein said steel plate has a Vs value, as defined by equation {1} below, of from about 0.15 to about 0.42, and a carbide size of less than about 5 microns:

$$Vs=C+(Mn/5)+5P-(Ni10)-(Mo/15)+(Cu/10) \quad \{1\}$$

wherein each atomic symbol represents its content in wt. %.

11. The method of claim 10, wherein said steel plate has a Vs value of about 0.28 to about 0.42.

12. The method of claim 10, wherein said steel plate further comprises 0 wt % to about 0.6 wt % Si, 0 wt % to about 0.1 wt % Al, 0 wt % to about 0.6 wt % Cu, 0 wt % to about 0.8 wt % Cr, 0 wt % to about 0.6 wt % Mo, 0 wt % to about 0.1 wt % V, 0 wt % to about 0.0025 wt % B, and 0 wt % to about 0.006 wt % Ca.

13. The method of claim 10, wherein said steel plate has a Ceq value, as defined by equation {2} below, of about 0.4 to about 0.7:

$$Ceq=C+(Mn/6)+\{(Cu+Ni)/15\}+\{(Cr+Mo+V)/5\} \quad \{2\}$$

wherein each atomic symbol represents its content in wt. %.

* * * * *